US009709224B2

(12) United States Patent
Jang

(10) Patent No.: US 9,709,224 B2
(45) Date of Patent: Jul. 18, 2017

(54) ILLUMINATION APPARATUS

(71) Applicant: LG INNOTEK CO., LTD., Seoul (KR)

(72) Inventor: Chul Ho Jang, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 8 days.

(21) Appl. No.: 14/296,278

(22) Filed: Jun. 4, 2014

(65) Prior Publication Data

US 2015/0016101 A1 Jan. 15, 2015

(30) Foreign Application Priority Data

Jun. 5, 2013 (KR) ..... 10-2013-0064493

(51) Int. Cl.

| | |
|---|---|
| ***F21V 1/00*** | (2006.01) |
| ***F21V 5/00*** | (2015.01) |
| ***F21V 7/00*** | (2006.01) |
| ***F21V 7/09*** | (2006.01) |
| ***F21K 9/27*** | (2016.01) |
| ***F21K 9/62*** | (2016.01) |
| ***F21K 9/68*** | (2016.01) |
| ***F21V 7/22*** | (2006.01) |
| ***F21V 19/00*** | (2006.01) |
| ***F21V 23/00*** | (2015.01) |
| ***F21Y 103/10*** | (2016.01) |

(Continued)

(52) U.S. Cl.

CPC ..... *F21K 9/54* (2013.01); *F21K 9/27* (2016.08); *F21K 9/62* (2016.08); *F21K 9/68* (2016.08); *F21V 7/005* (2013.01); *F21V 7/0008* (2013.01); *F21V 7/09* (2013.01); *F21V 29/74* (2015.01); *F21V 3/02* (2013.01); *F21V 7/22* (2013.01); *F21V 19/003* (2013.01); *F21V 23/009* (2013.01); *F21Y 2103/10* (2016.08); *F21Y 2115/10* (2016.08)

(58) Field of Classification Search

CPC ..... F21V 7/09; F21V 7/005; F21Y 2103/003; F21K 9/54

USPC ..... 362/217.05, 217.01, 346

See application file for complete search history.

(56) References Cited

U.S. PATENT DOCUMENTS 1,900,551 A * 3/1933 Guth ..... 362/348
6,092,913 A * 7/2000 Edwards, Jr. ..... 362/260

(Continued)

FOREIGN PATENT DOCUMENTS

KR 10-2013-0107114 A 10/2013

OTHER PUBLICATIONS

European Search Report dated Oct. 14, 2014 issued in Application No. 14 171 236.4.

*Primary Examiner* — Peggy Neils
*Assistant Examiner* — William N Harris
(74) *Attorney, Agent, or Firm* — KED & Associates, LLP

(57) ABSTRACT

An illumination apparatus includes a tube type light-transmissive cover, and light emitting module having a substrate provided in one region of an inner circumferential surface of the cover and a plurality of light emitting devices disposed on the substrate. A reflector extends in a longitudinal direction of the cover and includes a first reflective surface, a second reflective surface, and an edge positioned between the first reflective surface and the second reflective surface. One end of the first reflective surface and one end of the second reflective surface are connected to the inner circumferential surface of the cover.

20 Claims, 15 Drawing Sheets

(51) Int. Cl.

| | |
|---|---|
| ***F21Y 115/10*** | (2016.01) |
| ***F21V 29/74*** | (2015.01) |
| ***F21K 99/00*** | (2016.01) |
| *F21V 3/02* | (2006.01) |

(56) References Cited

U.S. PATENT DOCUMENTS

| | | | | |
|---|---|---|---|---|
| 8,702,270 | B2 * | 4/2014 | Wu | 362/235 |
| 2008/0285264 | A1 * | 11/2008 | Whitehouse et al. | 362/217 |
| 2011/0103053 | A1 * | 5/2011 | Chen | F21V 5/002 362/235 |
| 2012/0075850 | A1 * | 3/2012 | Chang | F21K 9/17 362/235 |
| 2012/0087119 | A1 * | 4/2012 | Chang | F21K 9/17 362/235 |
| 2012/0106144 | A1 * | 5/2012 | Chang | F21K 9/17 362/218 |
| 2012/0314409 | A1 | 12/2012 | Kim et al. | 362/218 |
| 2012/0320571 | A1 * | 12/2012 | Kim et al. | 362/147 |
| 2013/0170201 | A1 | 7/2013 | Chen | 362/233 |
| 2013/0176722 | A1 * | 7/2013 | Lay | F21S 8/04 362/231 |
| 2013/0235590 | A1 * | 9/2013 | Van Der Sijde | F21S 8/04 362/308 |
| 2014/0226328 | A1 * | 8/2014 | Schwarz | 362/235 |
| 2016/0076706 | A1 * | 3/2016 | Rebman | G02B 19/0066 362/223 |

* cited by examiner

ILLUMINATION APPARATUS

CROSS REFERENCE TO RELATED APPLICATION

This application claims priority under 35 U.S.C. §119 to Korean Patent Application No. 10-2013-0064493, filed in Korea on Jun. 5, 2013, whose entire disclosure is hereby incorporated by reference.

BACKGROUND

1. Field

Embodiments relate to a tube type light emitting diode illumination apparatus.

2. Background

Light emitting diodes (LEDs) have been increasingly used for indoor and outdoor decoration since they have a longer service life and a higher efficiency of light emission relative to power consumption than light sources such as a fluorescent lamp and a three wavelength lamp.

FIG. 15 is a cross-sectional view illustrating a common tube type illumination apparatus 1.

Referring to FIG. 15, the tube type illumination apparatus 1 may include a printed circuit board 10, a light emitting diode 20, a heat dissipation plate 30, and a light transmissive tube 40.

A sufficient number of light emitting diodes 20 to implement desired brightness may be installed on an upper portion of the printed circuit board 10. The heat dissipation plate 30 may be disposed under the printed circuit board 10 to dissipate heat generated in the light emitting diodes 20.

The light transmissive tube 40 may surround the printed circuit board 10 with the installed light emitting diodes 20 to protect the light emitting diodes 20 from external shock and foreign substances. In addition, since the light transmissive tube 40 is light-transmissive, it may integrate the light emitted from the light emitting diodes 20 and radiate the same to a wide outside area.

Since the tube type illumination apparatus 1 emits light in a specific direction (e.g., forward of the light emitting diodes), a beam angle may be between about 120° and about 135°.

The above references are incorporated by reference herein where appropriate for appropriate teachings of additional or alternative details, features and/or technical background.

BRIEF DESCRIPTION OF THE DRAWINGS

The embodiments will be described in detail with reference to the following drawings in which like reference numerals refer to like elements wherein.

DETAILED DESCRIPTION

Hereinafter, embodiments will be described with reference to the annexed drawings. It will be understood that when an element is referred to as being "on" or "under" another element, it can be directly on/under the element, and one or more intervening elements may also be present. When an element is referred to as being "on" or "under", "under the element" as well as "on the element" can be included based on the element.

Figure 1:
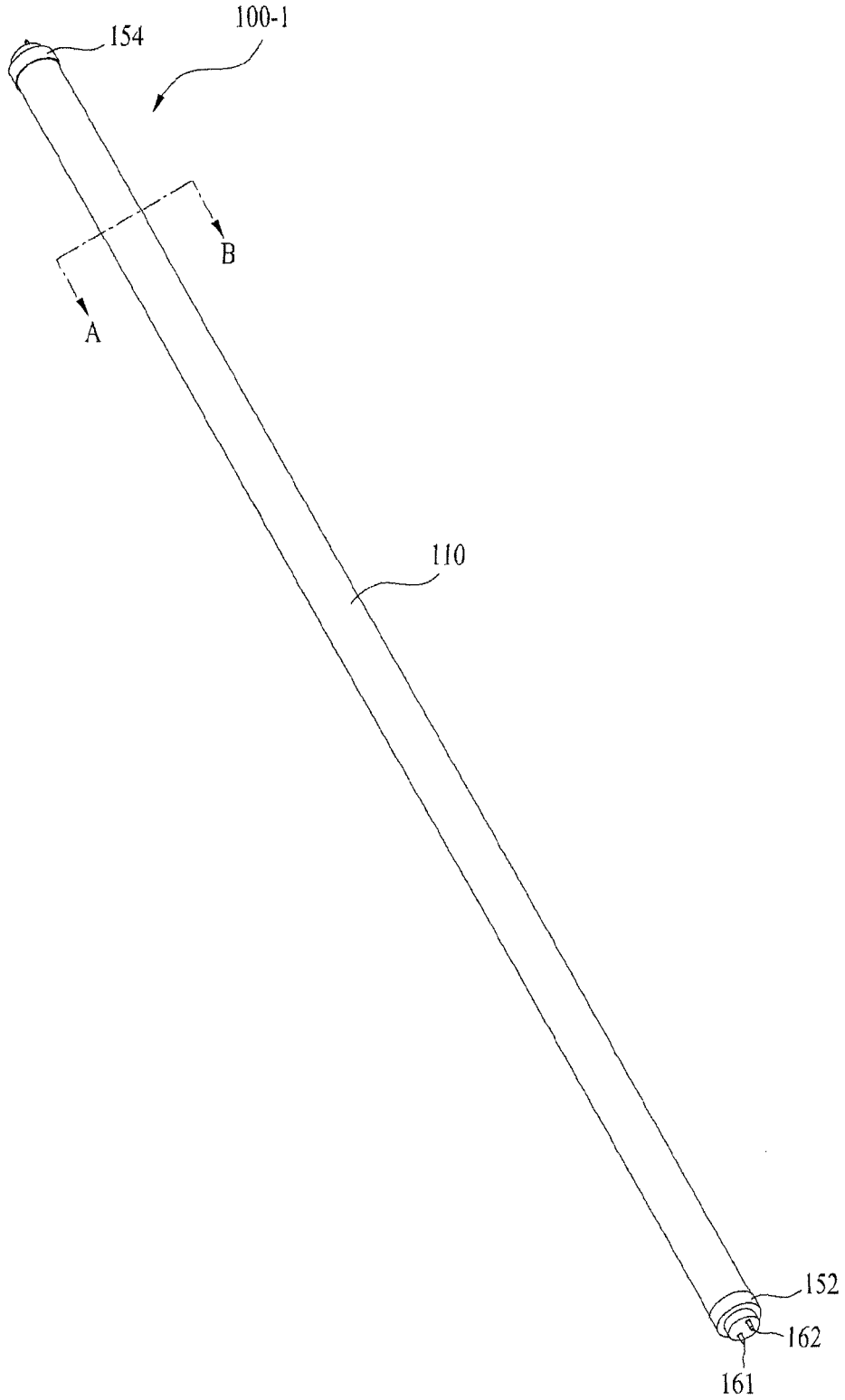
FIG. 1 is a perspective view illustrating the exterior of an illumination apparatus according to a first embodiment.
Figure 2:
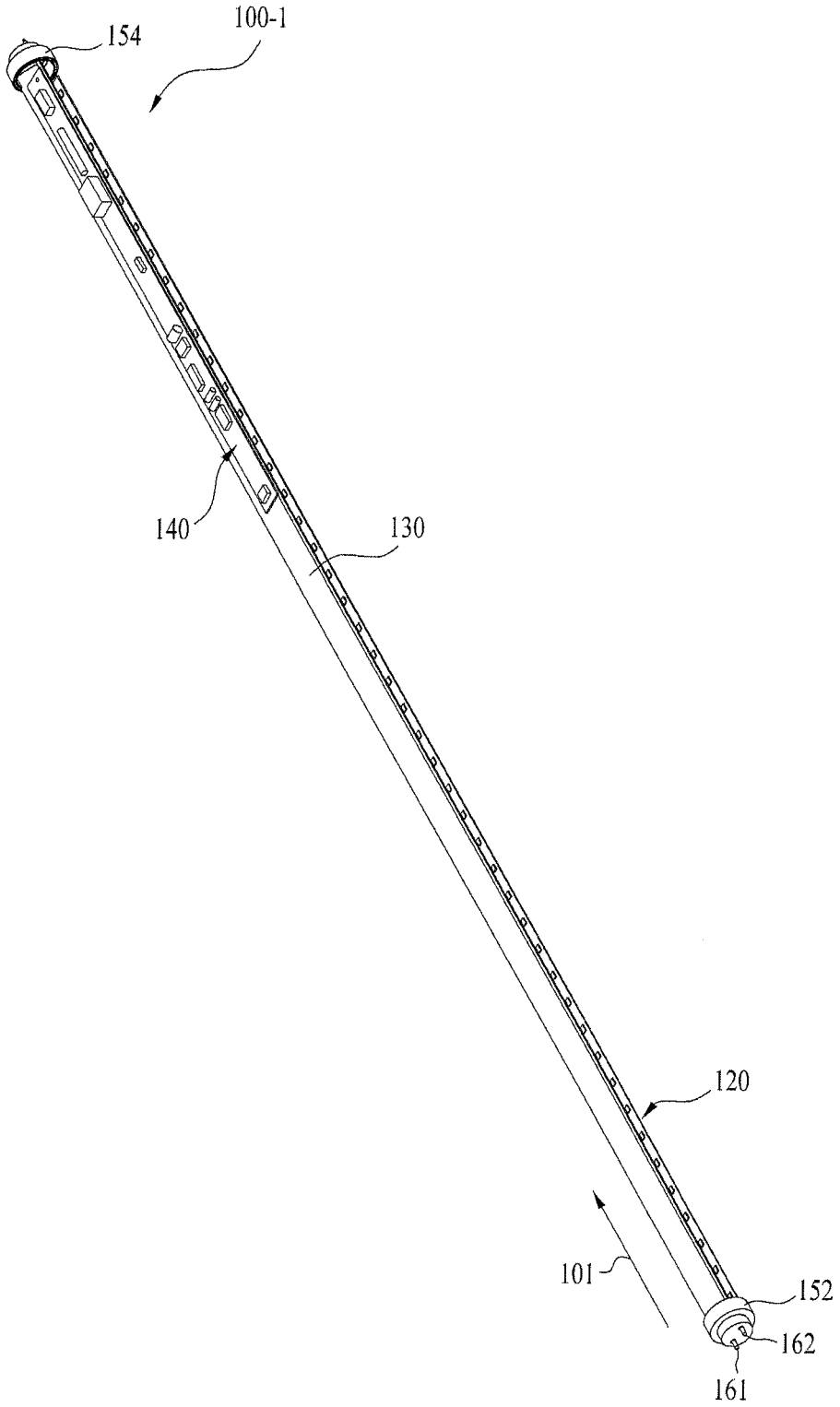
FIG. 2 is a perspective view illustrating the interior of the illumination apparatus with a cover removed.
Figure 3:
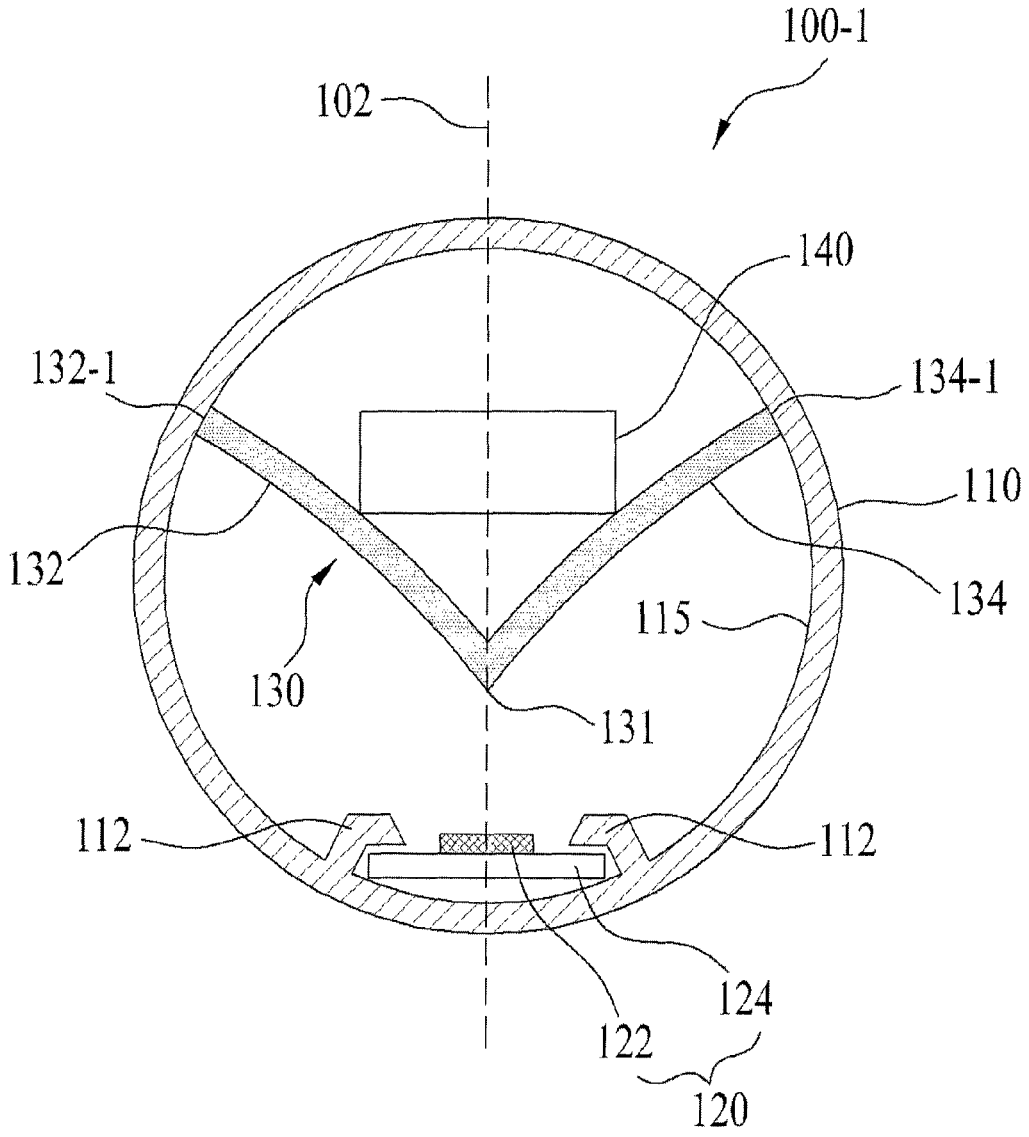
FIG. 3 is a cross-sectional view illustrating the illumination apparatus shown in FIG. 1, taken along line AB.

FIG. 1 is a perspective view illustrating the exterior of an illumination apparatus 100-1 according to a first embodiment, FIG. 2 is a perspective view illustrating the interior of the illumination apparatus 100-1 with a cover 110 removed, and FIG. 3 is a cross-sectional view illustrating the illumination apparatus 100-1 shown in FIG. 1, taken along ling AB.

Referring to FIGS. 1 to 3, the illumination apparatus 100-1 includes a cover 110, a light emitting module 120, a reflector 130, a drive unit 140, connection caps 152 and 154, and electrode pins 161 and 162.

The cover 110 may be light-transmissive and formed in a tubular shape. The cover 110 may accommodate the light emitting module 120, reflector 130, and the drive unit 140 and protect the constituents 120, 130 and 140 from external shock and foreign substances. The cover 110 may allow light radiated from the light emitting module 120 and the reflector 130 to be transmitted therethrough.

The cover 110 may be light-transmissive and formed of synthetic resin capable of diffusing light. For example, the cover 110 may be formed of at least one selected among polycarbonate resin, acrylic resin, polyethylene terephthalate resin, olefin-based resin, or silicone resin. The cover 110 may be formed through injection molding of such synthetic resin materials.

The light emitting module 120 may be disposed in a region at one side of an inner circumferential surface 115 of the cover 110. The light emitting module 120 may include a substrate 124 and a plurality of light emitting devices 122.

The substrate 124 may be a printed circuit board and formed in the shape of a quadrangular plate extending in the longitudinal direction 101 of the cover 110. However, the shape of the substrate 124 is not limited thereto.

The light emitting devices 122 may be disposed on the substrate 124 and spaced apart from each other in the first direction 101 (see FIG. 2). The first direction 101 may be the longitudinal direction of the substrate 124 or the cover 110.

Each of the light emitting devices 122 may be a light emitting diode (LED).

A first region 115-1 positioned at one side of the inner circumferential surface 115 of the cover 110 may be provided with a protrusion 112 allowing the substrate 124 of the light emitting module 120 to be inserted or fitted thereinto in the first direction.

For example, the substrate 124 may be disposed on the first region 115-1 positioned at one side of the inner circumferential surface 115 of the cover 110, and the light emitting devices 122 may be aligned with a vertical centerline 102 of the cover 110 to ensure uniform distribution or symmetrical distribution of light. Herein, the vertical centerline 102 may be a line passing through the first region 115-1, the center of the cover 110, and a second region 115-2. The vertical centerline 102 may be a straight line perpendicular to the substrate 124. The reflector 130 may be disposed between the second region 115-2 positioned at another side of the inner circumferential surface 115 of the cover 110 and the light emitting devices 122. The reflector 130 may reflect light radiated from the light emitting devices 122. Herein, the second region 115-2 may be a region facing the first region 115-1.

Opposite ends of the reflector 130 may be fixed to the inner circumferential surface 115 of the 110. The reflector 130 may be a reflective sheet or reflective plate having a convex center in the direction of the light emitting module 120.

The reflector 130 may include a first reflective surface 132 and second reflective surface 134 extending in the longitudinal direction 101 of the cover 110, and an edge 131 positioned between the first reflective surface 132 and the second reflective surface 134.

Ends 132-1 and 134-1 of the first reflective surface 132 and the second reflective surface 134 may be connected or fixed to different regions of the inner circumferential surface 115 of the cover 110, and the other ends of the first reflective surface 132 and the second reflective surface 134 may adjoin the edge 131.

For example, one end 132-1 of the first reflective surface 132 may be positioned on one side of the vertical centerline 102, and the one end 134-1 of the second reflective surface 134 may be positioned on the other side of the vertical centerline 102.

Herein, the one end 132-1, 134-1 of each of the first reflective surface 132 and the second reflective surface 134 may be one of the long lateral faces among the lateral faces of each of the first reflective surface 132 and the second reflective surface 134. The other end of each of the first reflective surface 132 and the second reflective surface 134 may be the other one of the long lateral faces of each of the first reflective surface 132 and the second reflective surface 134.

The edge 131 of the reflector 130 may be positioned lower than the ends 132-1 and 134-1 of the first reflective surface 132 and the second reflective surface 134 fixed to the inner circumferential surface 115 of the cover 110.

Figure 4:
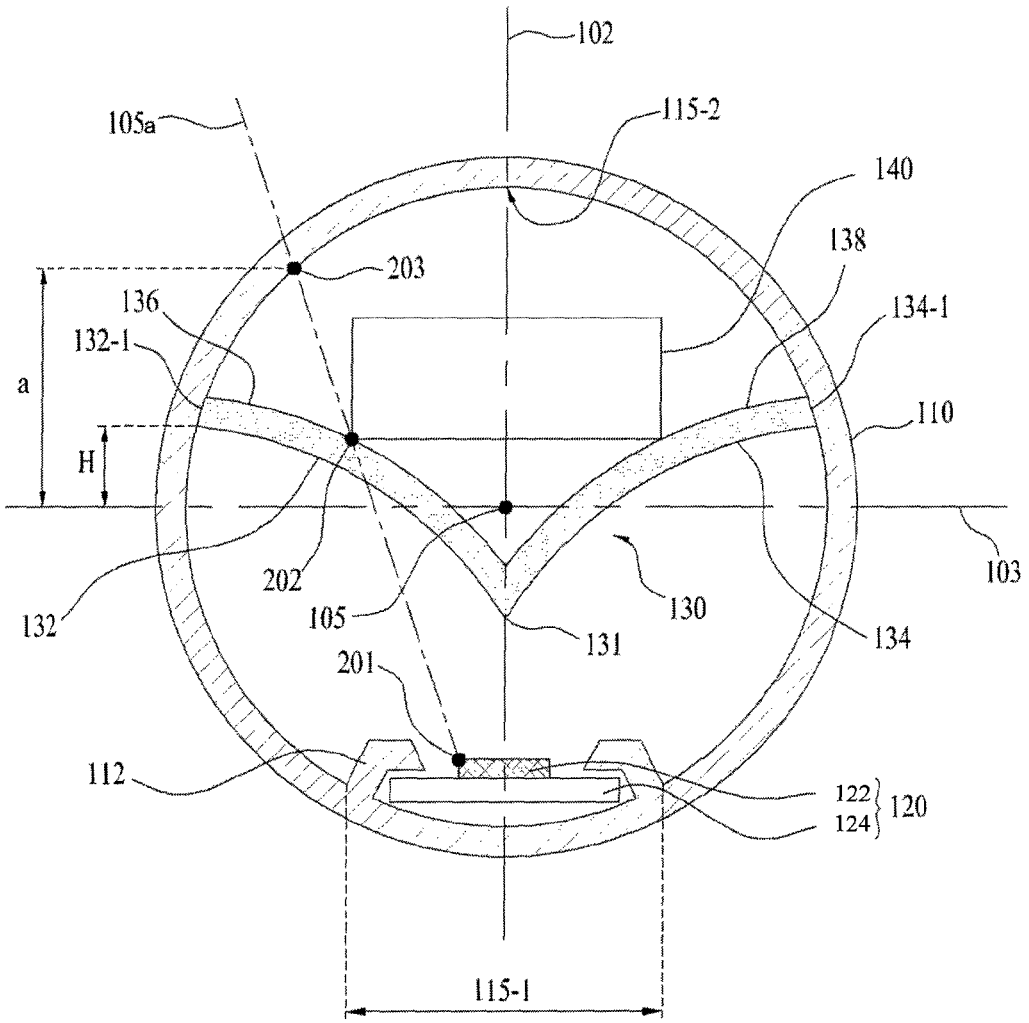
FIG. 4 is a view showing the height of one end of each of the first reflective surface and the second reflective surface shown in FIG. 1.

FIG. 4 is a view showing the height of one end 132-1, 134-1 of each of the first reflective surface 132 and second reflective surface 134 shown in FIG. 1.

Referring to FIG. 4, the position of the edge 131 of the reflector 130 may be lower than the positions of the ends 132-1 and 134-1 of the first reflective surface 132 and the second reflective surface 134 fixed to the inner circumferential surface 115 of the cover 110 with respect to the upper surface of the substrate 124.

For example, the ends 132-1 and 134-1 of the first reflective surface 132 and the second reflective surface 134 may be positioned above a horizontal centerline 103. The edge 131 of the reflector 130 may be positioned below the horizontal centerline 103. Herein, the horizontal centerline 103 may be a line passing through the center 105 of the cover 110. The horizontal centerline 103 may be a straight line parallel to the substrate 124. The vertical centerline 102 and the horizontal centerline 103 may cross each other at right angles.

For example, the height H of the position of the ends 132-1 and 134-1 of the first reflective surface 132 and the second reflective surface 134 from the horizontal centerline 103 may be greater than the height of the position of the horizontal centerline 103 and less than a reference value a ($0<H<a$). Herein, the reference value a may be a height of the position of a point 203 at which an extension of a straight line connecting an edge 201 of the upper surface of the light emitting devices 122 to an edge 202 of the lower surface of the drive unit 140 meets the inner circumferential surface 115 of the cover 110. In this embodiment, the ends 132-1 and 134-1 of the first reflective surface 132 and the second reflective surface 134 are positioned at the height H greater than the height of the position of the horizontal centerline 103 to increase the beam angle.

In addition, the height H of the position of the ends 132-1 and 134-1 of the first reflective surface 132 and the second reflective surface 134 is set to be less than the reference value a to secure a space for insertion of the drive unit 140. In the case that the height H of the position of the ends 132-1 and 134-1 of the first reflective surface 132 and the second reflective surface 134 is set to be greater than the reference value a, a dark region may be created in the cover 110 by the drive unit 140.

The first reflective surface 132 and the second reflective surface 134 may be concavely curved surfaces. To equally distribute the light radiated from the light emitting module 120 to both sides of the edge 131 of the reflector 130, the first reflective surface 132 and second reflective surface 134 may be laterally symmetrical to each other with respect to the edge 131.

The reflector 130 may be formed of a material having high reflectivity. The reflector 130 may be formed of an insulation material to improve electrical insulation between the light emitting module 120 and the drive unit 140.

For example, the reflector 130 may be formed of white resin, a synthetic resin containing distributed white pigment, or a synthetic resin containing distributed metal particles having a high light reflectivity.

Herein, the white pigment may employ titanium dioxide, aluminum oxide, zinc oxide, lead carbonate, barium sulfate, calcium carbonate, and the like, and the synthetic resin may employ polyethylene terephthalate, polyethylene naphthalate, acrylic resin, polycarbonate, polystyrene, polyolefin, cellulose acetate, weather-resistant vinyl chloride, and the like. However, embodiments are not limited thereto.

The cover 110 and the reflector 130 may be formed through double injection molding of different materials. However, embodiments are not limited thereto.

The drive unit 140 may be positioned between the second region 115-2 positioned at another side of the inner circumferential surface 115 of the cover 110 and the reflector 130. The reflector 130 may support the drive unit 140.

For example, the drive unit 140 may be inserted into a space present between the second region 115-2 positioned at another side of the inner circumferential surface 115 of the cover 110 and the reflector 130.

The drive unit 140 may be positioned on the surfaces 136 and 138 positioned at the opposite side of the first reflective surface 132 and second reflective surface 134. The drive unit 140 may supply power to drive the light emitting module 120. For example, the drive unit 140 may convert alternating current power source externally supplied through the electrode pins 161 and 162 into direct current power source and supply the converted current power source to the light emitting module 120.

The light emitting module 120 and the drive unit 140 may be positioned on the opposite sides of the reflector 130 and may be separated or isolated from each other by the reflector 130. Electrical connection between the light emitting module 120 and the drive unit 140 may be implemented through a separate connection line.

Since the light emitting module 120 and the drive unit 140 are separable from each other by the reflector 130, a separate insulation sheet does not need to be used to enhance insulation of the drive unit 140.

The connection caps 152 and 154 are connected to both ends of the cover 110 to close the cover 110. One end of each of the electrode pins 161 and 162 may protrude out of the connection caps 152 and 154, and the other end of each of the electrode pins 161 and 162 may be electrically connected to the drive unit 140.

Figure 14:
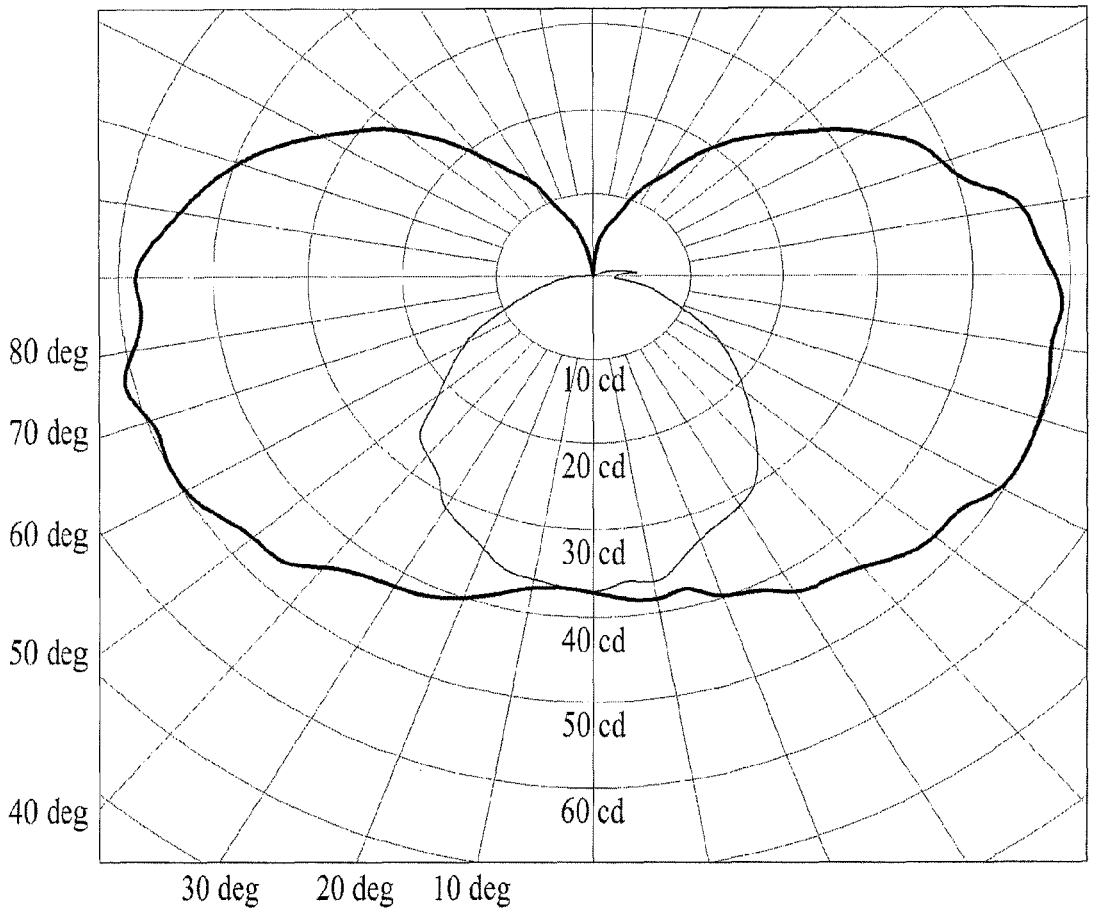
FIG. 14 is a view depicting the result of measurement of beam angles of the illumination apparatus shown in FIG. 1.

FIG. 14 is a view depicting the result of measurement of beam angles of the illumination apparatus 100-1 shown in FIG. 1.

According to the result of measurement depicted in FIG. 14, the illumination apparatus 100-1 may obtain a beam angle of 280°.

Figure 15:
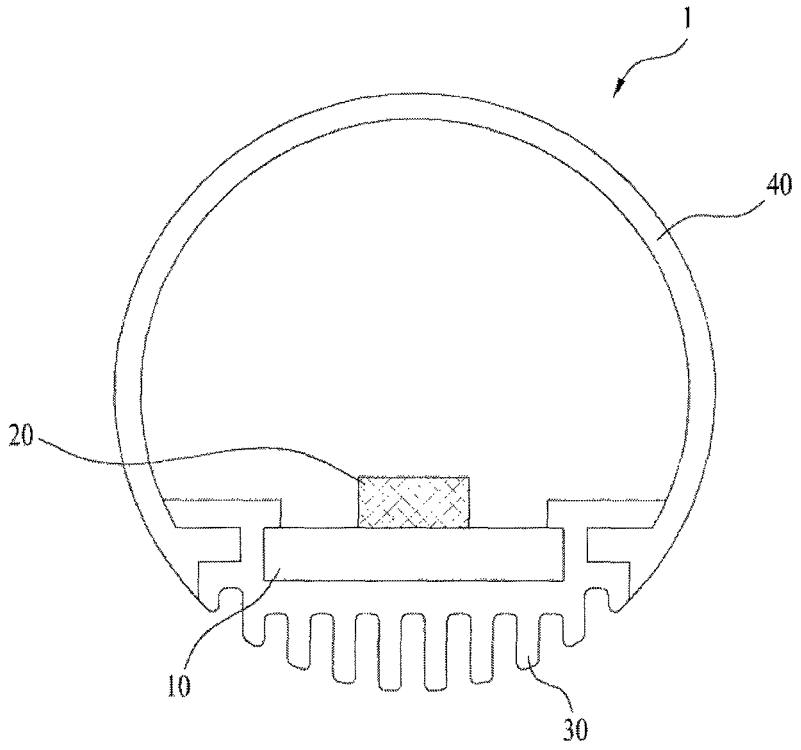
FIG.15 PRIOR ART
FIG. 15 is a cross-sectional view illustrating a typical tube type illumination apparatus.

While the beam angle of the illumination apparatus 1 shown in FIG. 15 is less than 180°, this embodiment may obtain a beam angle greater than or equal to 180°.

Figure 5:
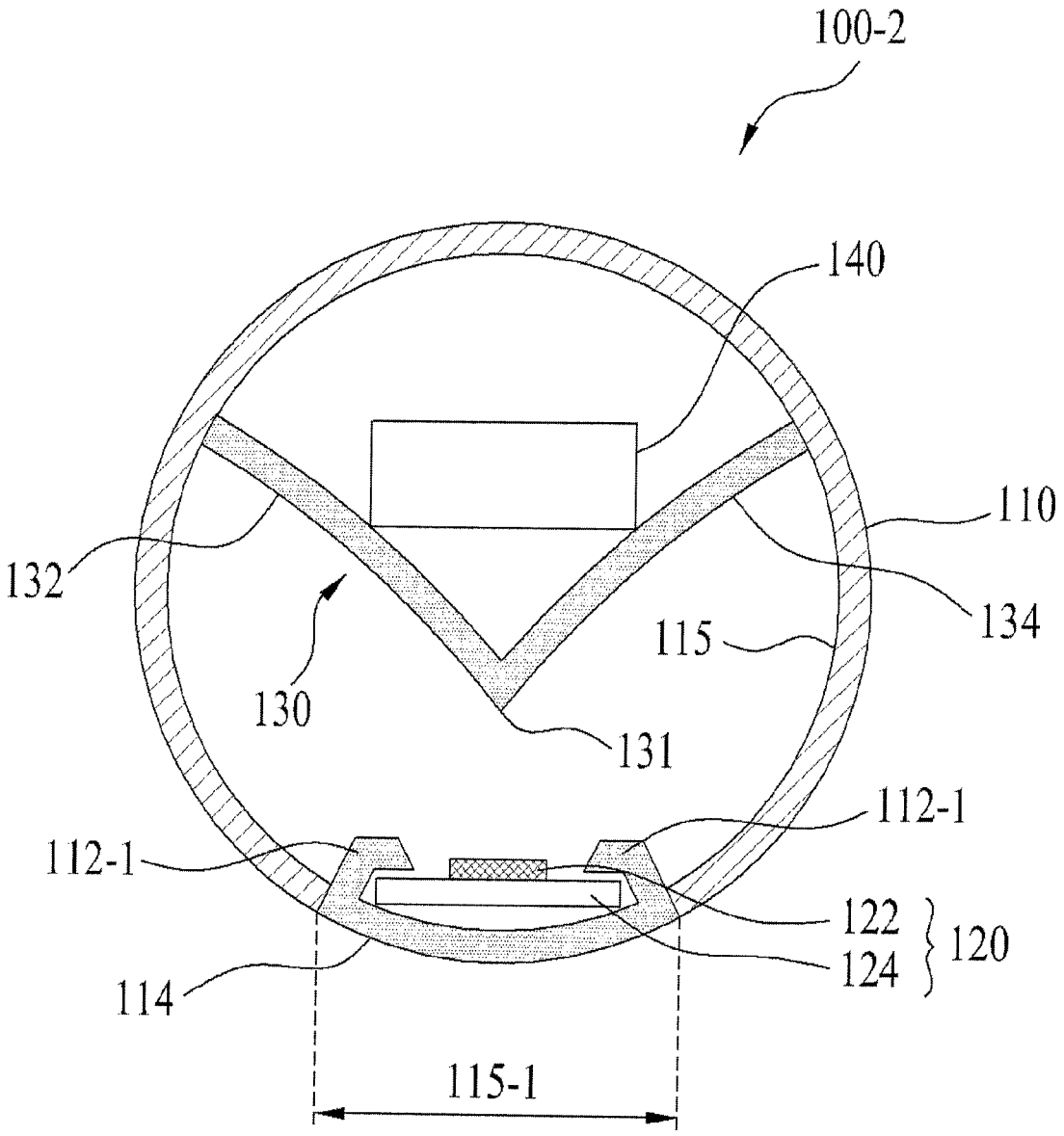
FIG. 5 is a cross-sectional view illustrating an illumination apparatus according to a second embodiment.
Figure 6:
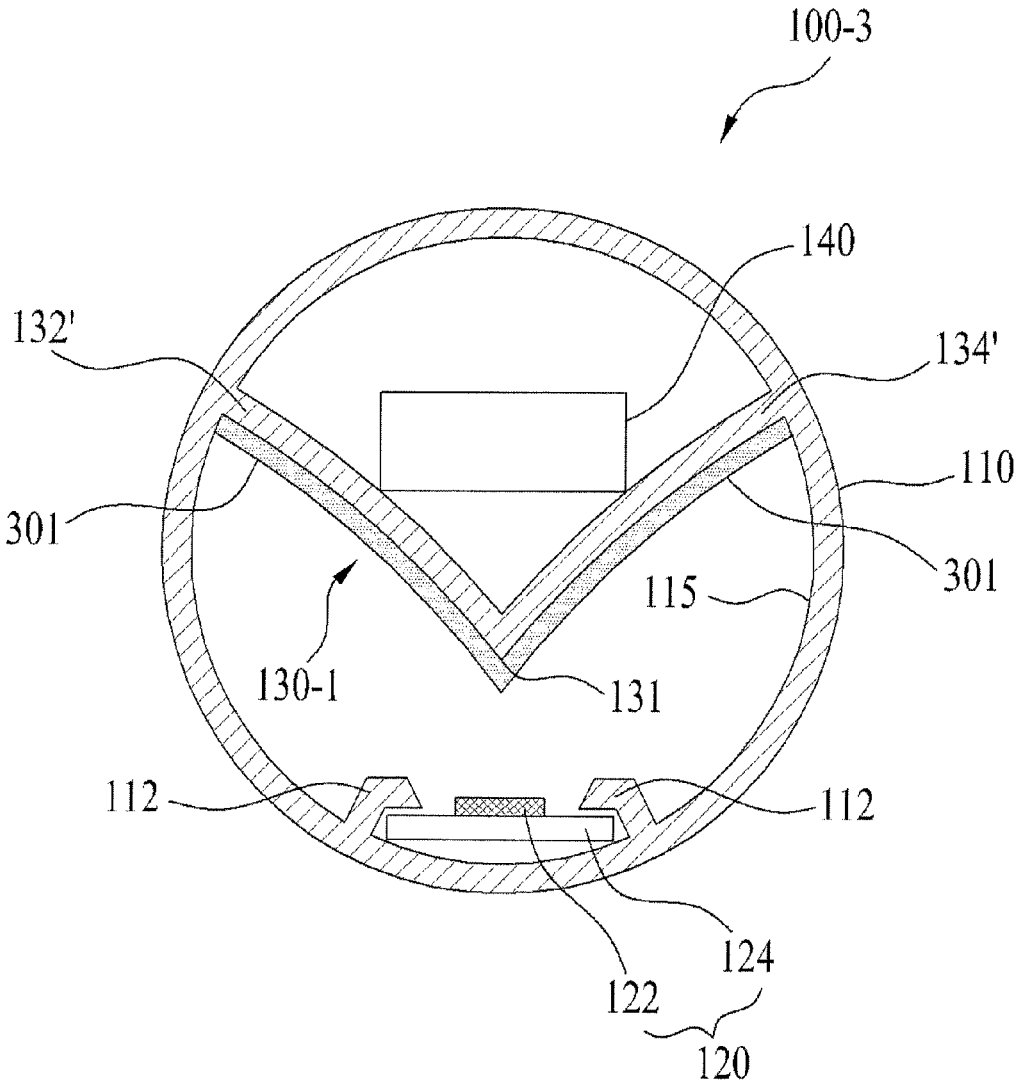
FIG. 6 is a cross-sectional view illustrating an illumination apparatus according to a third embodiment.

FIG. 5 is a cross-sectional view illustrating an illumination apparatus 100-2 according to a second embodiment. Some reference numerals in FIG. 6 represent the same constituents as reference numerals in FIG. 3, and thus description thereof will be briefly given or omitted.

Referring to FIG. 5, the illumination apparatus 100-2, which is a variation of the first embodiment, may include a protrusion 112-1 formed of a reflective material, unlike the first embodiment.

That is, while the protrusion 112 of the first embodiment is formed of the same light-transmissive material as that of the cover 110, the protrusion 112-1 of the second embodiment may be formed of the same reflective material as that of the reflector 130.

In addition, a first region 115-1 positioned at one side of the inner circumferential surface 115 of the cover 110, in which the light emitting module 120 is disposed, may be formed of a reflective material.

Since the protrusion 112-1 and the first region 115-1 of the cover 110 are formed of a reflective material, the illumination apparatus 100-2 of the second embodiment may re-reflect the light reflected toward the light emitting module 120 by the reflector 130. Thereby, the degree of brightness and the beam angle of the illumination apparatus 100-2 may be increased.

FIG. 6 is a cross-sectional view illustrating an illumination apparatus 100-3 according to a third embodiment. Some reference numerals in FIG. 6 represent the same constituents as reference numerals in FIG. 3, and thus description thereof will be briefly given or omitted.

Referring to FIG. 6, the illumination apparatus 100-3, which is a variation of the first embodiment, may include a reflector 130-1 having a different structure than in the first embodiment.

The reflector 130-1 may include first and second reflective surfaces 132' and 134' and reflective member 301. The structure of the first and second reflective surfaces 132' and 134' is identical to that of the first and second reflective surfaces 132 and 134 of the first embodiment. However, the first and second reflective surfaces 132' and 134' may be formed of the same light-transmissive material as that of the cover 110.

The reflective member 301 may be disposed on the first and second reflective surfaces 132' and 134' and formed of a reflective material. The reflective member 301 may be formed by applying a reflective material to the first and second reflective surfaces 132' and 134', or a sheet-shaped reflective member 301 may be adhered to the first and second reflective surfaces 132' and 134'. However, embodiments are not limited thereto.

Figure 7:
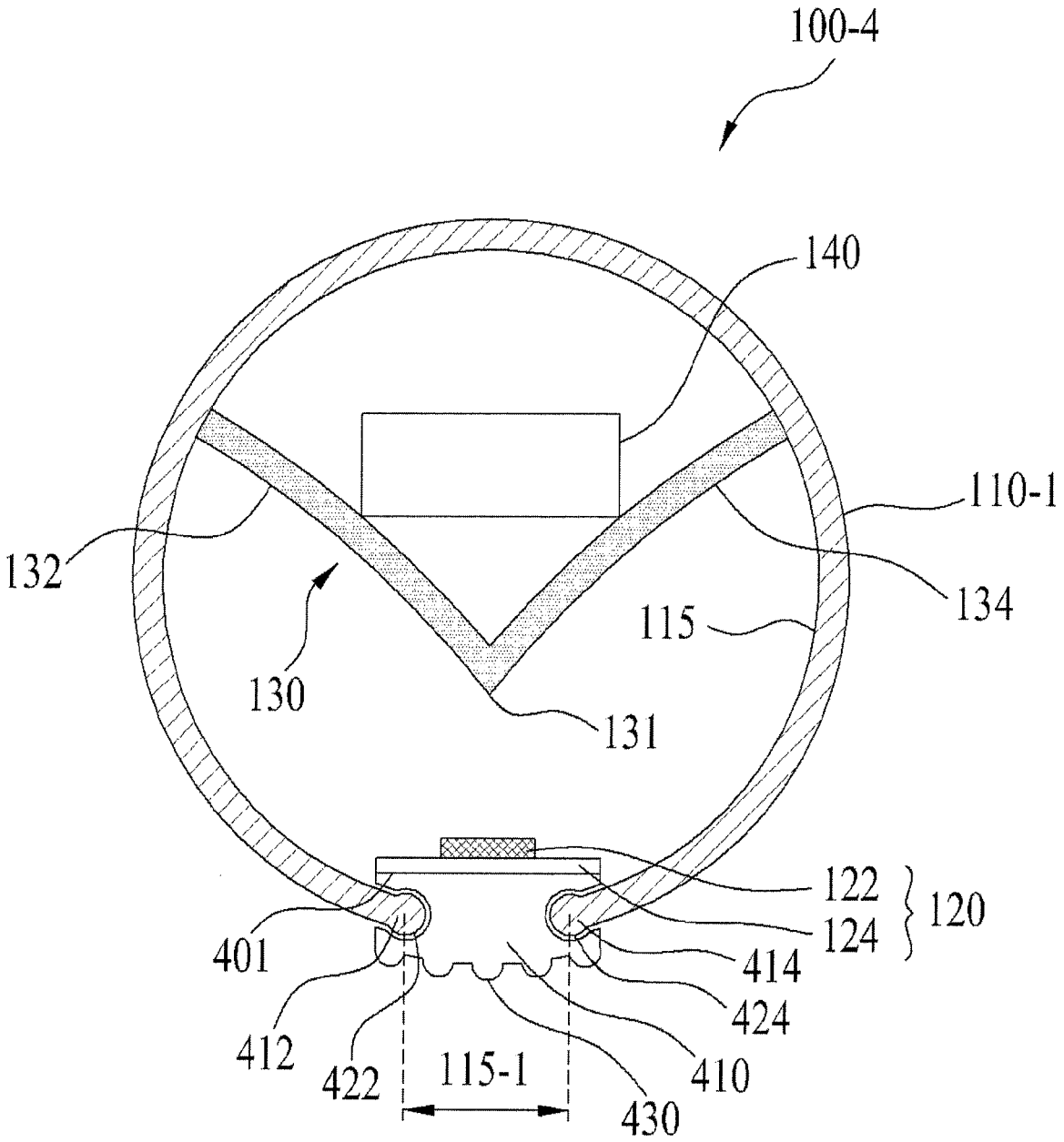
FIG. 7 is a cross-sectional view illustrating an illumination apparatus according to a fourth embodiment.

FIG. 7 is a cross-sectional view illustrating an illumination apparatus 100-4 according to a fourth embodiment. Some reference numerals in FIG. 7 represent the same constituents as reference numerals in FIG. 3, and thus description thereof will be briefly given or omitted.

Referring to FIG. 7, the illumination apparatus 100-4, which is a variation of the first embodiment, may include a cover 110-1 having a different structure than in the first embodiment and further include a heat dissipation part 410.

The cover 110 of the first embodiment is open at both ends thereof, and the lateral portion or outer circumferential surface thereof positioned at both ends of the cover 110 has a closed tube structure.

On the other hand, in the fourth embodiment, the cover 110-1 is open at both ends thereof, and the lateral portion or outer circumferential surface of the cover 110-1 is formed in the shape of an open tube, and thus the cross section thereof may form an arc larger than a half circle. For example, in the structure of the cover 110-1, the first region 115-1 positioned at one side of the 115 of the cover 110 as shown in FIG. 1 is open or removed.

As the lateral portion or outer circumferential surface of the cover 110-1 is open, the cover 110-1 may have opposite ends 412 and 414 spaced apart from each other.

The heat dissipation part 410 may be inserted between opposite ends 412 and 414 of the cover 110-1 and fixed. The heat dissipation part 410 may extend in the first direction to connect the opposite ends 412 and 414 of the cover 110-1. The lateral portion or outer circumferential surface of the cover 110-1 may be closed by the heat dissipation part 410.

Each of opposite lateral surfaces of the heat dissipation part 410 facing each other may be provided with a groove 422, 424 allowing a corresponding one of the opposite ends 412 and 414 of the cover 110-1 to be inserted thereinto.

For example, one end 412 of the cover 110-1 may be fitted into a first groove 422 provided on one lateral surface of the heat dissipation part 414, and the other end 414 of the cover 110-1 may be fitted into a second groove 424 provided on the opposite lateral surface of the heat dissipation part 414.

The upper surface 401 of the heat dissipation part 410 may face the reflector 130, and the light emitting module 120 may be disposed on the upper surface 401 of the heat dissipation part 410. For example, the substrate 124 may be disposed on the upper surface 401 of the heat dissipation part 410, and the light emitting devices 122 may be disposed on the substrate 124.

Since the heat dissipation part 410 serves to discharge heat generated in the light emitting module 120 to the outside, it may be formed of a material having a high heat dissipation rate, e.g., aluminum or carbon fiber reinforced plastic (CFRP). Heat dissipation fins 430 to increase heat dissipation efficiency may be provided on the lower surface of the heat dissipation part 410.

Figure 8:
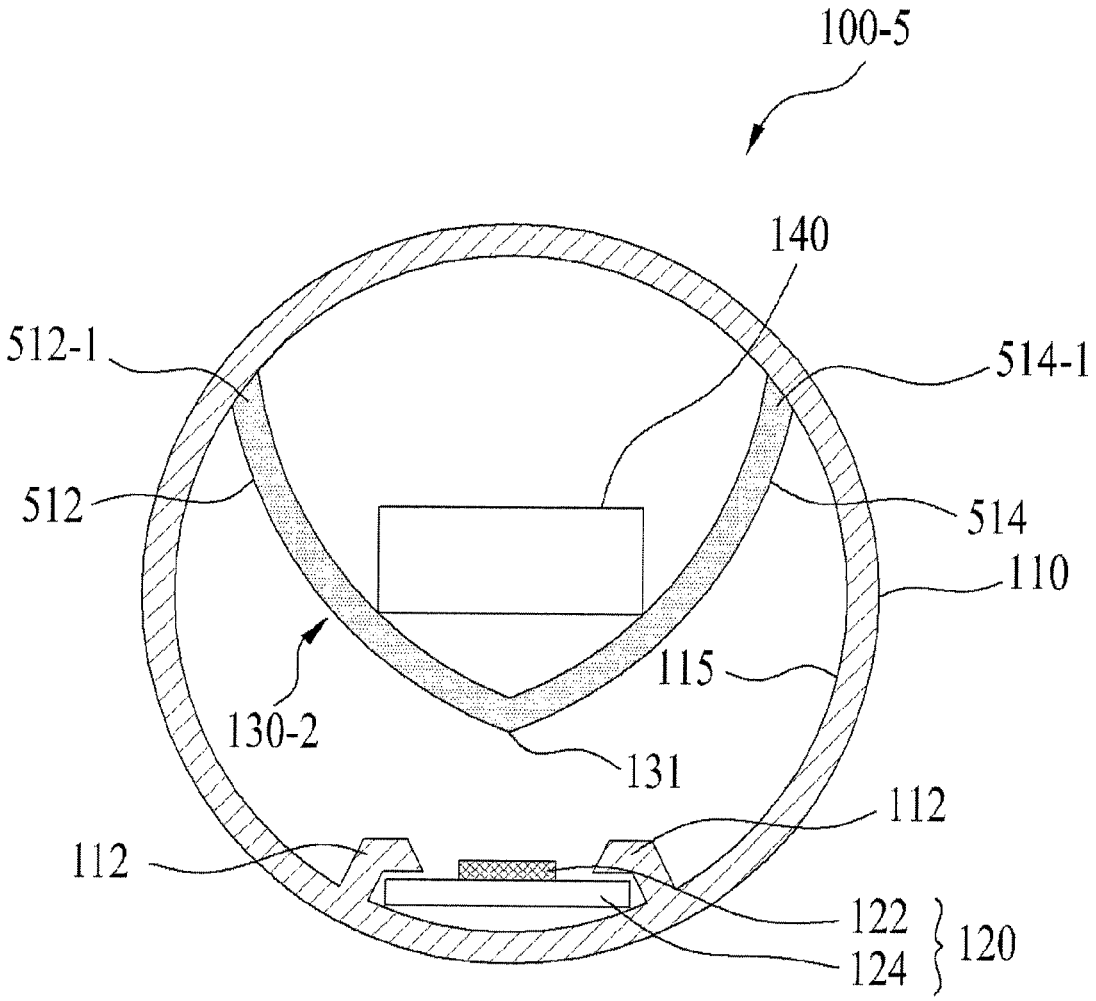
FIG. 8 is a cross-sectional view illustrating an illumination apparatus according to a fifth embodiment.

FIG. 8 is a cross-sectional view illustrating an illumination apparatus 100-5 according to a fifth embodiment. Some reference numerals in FIG. 8 represent the same constituents as reference numerals in FIG. 3, and thus description thereof will be briefly given or omitted.

Referring to FIG. 8, the illumination apparatus 100-5, which is a variation of the first embodiment, may include a reflector 130-2 having a different structure than the first embodiment.

While the first and second reflective surfaces 132 and 134 of the first embodiment are concavely curved surfaces in the direction of the first region 115-1 of the cover 110, the first and second reflective surfaces 512 and 514 of the fifth embodiment may be convexly curved surfaces in the direction of the first region 115-1 of the cover 110. The first reflective surface 512 and the second reflective surface 514 may be laterally symmetrical to each other about the edge 131. The fifth embodiment may implement a different beam angle than the first embodiment.

The edge 131 of the reflector 130-2 and one end 512-1, 514-1 of each of the first and second reflective surfaces 512 and 514 may be positioned at heights as illustrated in FIG. 4.

Figure 9:
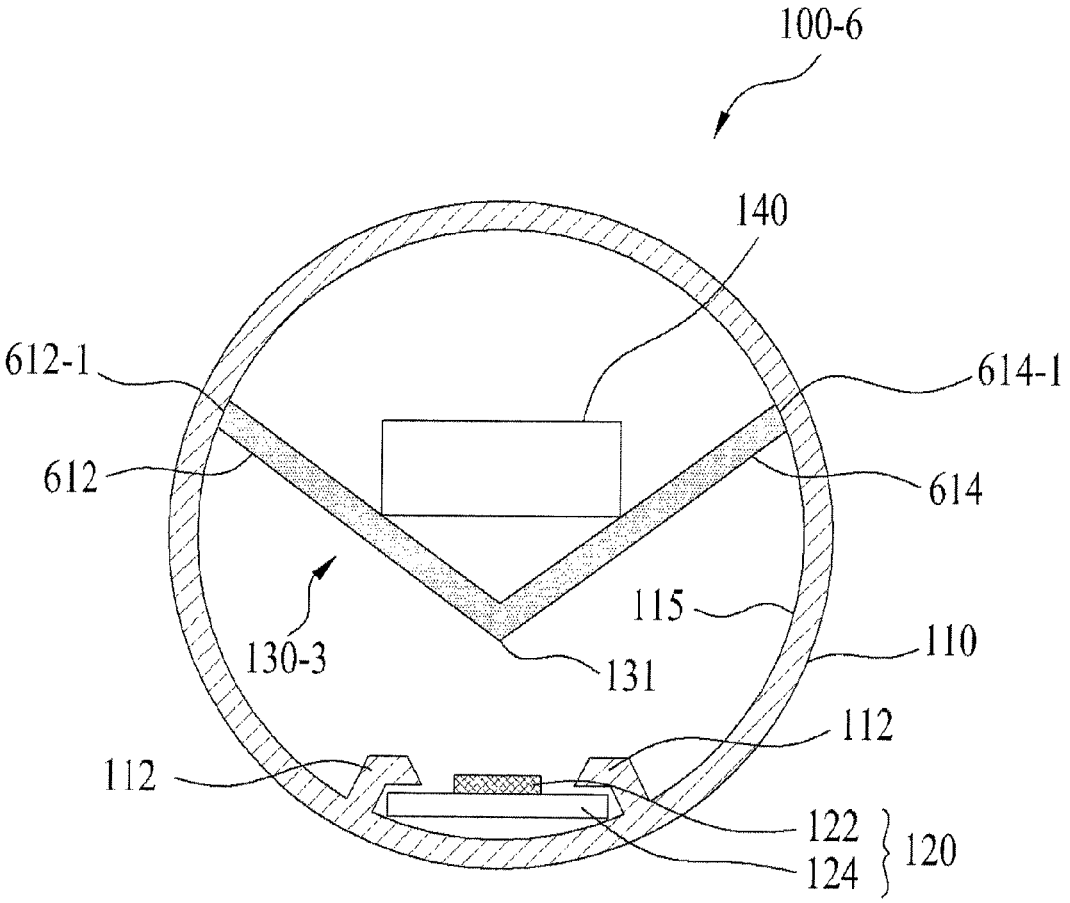
FIG. 9 is a cross-sectional view illustrating an illumination apparatus according to a sixth embodiment.

FIG. 9 is a cross-sectional view illustrating an illumination apparatus 100-6 according to a sixth embodiment. Some reference numerals in FIG. 9 represent the same constituents as reference numerals in FIG. 3, and thus description thereof will be briefly given or omitted.

Referring to FIG. 9, the illumination apparatus 100-6 is a variation of the first embodiment. While the first and second reflective surfaces 132 and 134 of the first embodiment are concavely curved surfaces, the first and second reflective surfaces 612 and 614 included in the reflector 130-3 may be flat surfaces. The sixth embodiment may implement a different beam angle over the first embodiment. The first reflective surface 612 and the second reflective surface 614 may be laterally symmetrical to each other about the edge 131.

The edge 131 of the reflector 130-3 and one end 612-1, 614-1 of each of the first and second reflective surfaces 612 and 614 may be positioned at heights as illustrated in FIG. 4.

Figure 10:
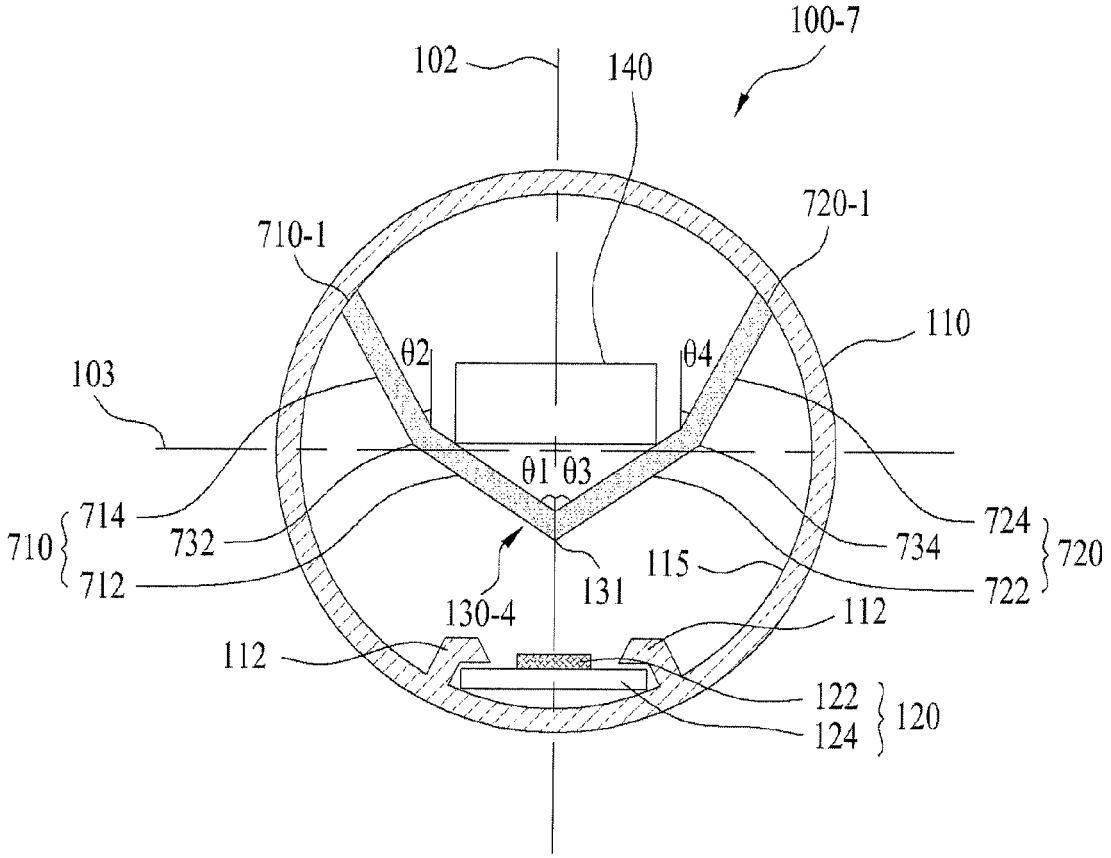
FIG. 10 is a cross-sectional view illustrating an illumination apparatus according to a seventh embodiment.

FIG. 10 is a cross-sectional view illustrating an illumination apparatus 100-7 according to a seventh embodiment. Some reference numerals in FIG. 10 represent the same constituents as reference numerals in FIG. 3, and thus description thereof will be briefly given or omitted.

Referring to FIG. 10, the illumination apparatus 100-7 is a variation of the first embodiment. The reflector 130-4 of the seventh embodiment may include first and second reflective surfaces 710 and 720 and an edge 131. Each of the first and second reflective surfaces 710 and 720 may include at least two sub-reflective surfaces 712 and 714, 722 and 724 having different slopes. Herein, the slope may indicate a degree of inclination with respect to the vertical centerline 102. The first reflective surface 710 and the second reflective surface 720 may be laterally symmetrical to each other about the edge 131.

For example, the first reflective surface 710 may include a first sub-reflective surface 712 having a first slope θ1 and a second sub-reflective surface 714 having a second slope θ2. The second reflective surface 720 may include a third sub-reflective surface 722 having a third slope θ3 and a fourth sub-reflective surface 724 having a fourth slope θ4.

The first slope θ1 may be equal to the third slope θ3, and the second slope θ2 may be equal to the fourth slope θ4. However, embodiments are not limited thereto. To implement various beam angles, the first to fourth slopes θ1 to θ4 may be different from each other. The second sub-reflective surface 714 and the fourth sub-reflective surface 724 may adjoin the inner circumferential surface of the cover 110, and the first sub-reflective surface 712 and the third sub-reflective surface 722 may adjoin to form the edge 131. The first to fourth sub-reflective surfaces 712, 714, 722 and 724 may be flat surfaces.

The seventh embodiment may implement a different beam angle than the first embodiment. The edge 131 of the reflector 130-4 and one end 710-1, 720-1 of each of the first and second reflective surfaces 710 and 720 may be positioned at heights as illustrated in FIG. 4.

A first sub-edge 732 between the first sub-reflective surface 712 and the second sub-reflective surface 714 and a second sub-edge 734 between the third sub-reflective surface 722 and the fourth sub-reflective surface 724 may be positioned above the horizontal centerline 103. However, embodiments are not limited thereto. In another embodiment, the first sub-edge 732 and second sub-edge 734 may be positioned on or lower than the horizontal centerline 103.

Figure 11:
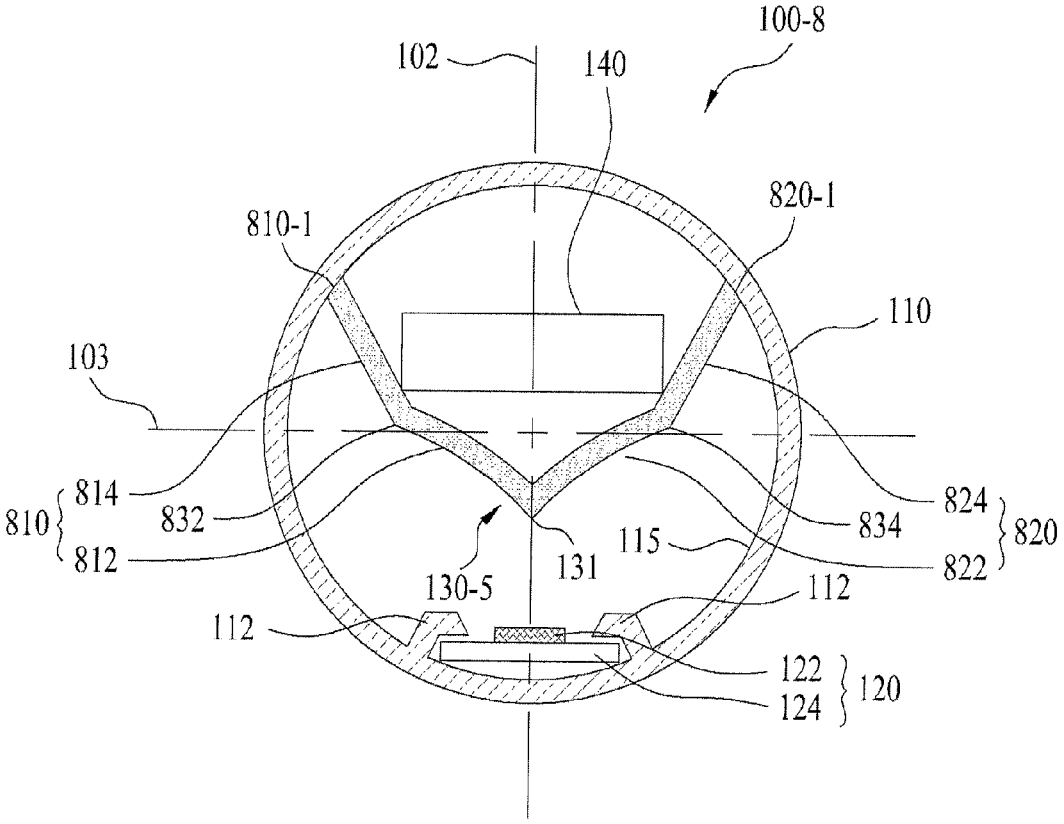
FIG. 11 is a cross-sectional view illustrating an illumination apparatus according to an eighth embodiment.

FIG. 11 is a cross-sectional view illustrating an illumination apparatus 100-8 according to an eighth embodiment. Some reference numerals in FIG. 11 represent the same constituents as reference numerals in FIG. 3, and thus description thereof will be briefly given or omitted.

Referring to FIG. 11, the illumination apparatus 100-8 is a variation of the first embodiment. A reflector 130-5 of the eighth embodiment may include first and second reflective surfaces 810 and 820 and an edge 131. Each of the first and second reflective surfaces 810, 820 may include a sub-reflective surface 812 or 822 provided with a curved surface, and a sub-reflective surface 814, 824 provided with a flat surface. The 810 and second reflective surface 820 may be laterally symmetrical to each other about the edge 131.

For example, the first reflective surface 810 may include a first sub-reflective surface 812 and a second sub-reflective surface 814, and the second reflective surface 820 may include a third sub-reflective surface 822 and a fourth sub-reflective surface 824.

The second sub-reflective surface 814 and the fourth sub-reflective surface 824 may adjoin the inner circumferential surface of the cover 110, and the first sub-reflective surface 812 and the third sub-reflective surface 822 may adjoin to form the edge 131.

The second sub-reflective surface 814 and the fourth sub-reflective surface 824 may be flat surfaces, and the first sub-reflective surface 812 and the third sub-reflective surface 822 may be concavely curved surfaces.

According to another embodiment, the second sub-reflective surface 814 and the fourth sub-reflective surface 824 may be flat surfaces, and the first sub-reflective surface 812 and the third sub-reflective surface 822 may be convexly curved surfaces.

According to another embodiment, the second sub-reflective surface 814 and the fourth sub-reflective surface 824 may be concavely curved surface, and the first sub-reflective surface 812 and the third sub-reflective surface 822 may be flat surfaces.

According to another embodiment, the second sub-reflective surface 814 and the fourth sub-reflective surface 824 may be convexly curved surfaces, and the first sub-reflective surface 812 and the third sub-reflective surface 822 may be flat surfaces.

The eighth embodiment may implement a different beam angle than the first embodiment. The edge 131 of the reflector 130-5 and one end 810-1, 820-1 of each of the first and second reflective surfaces 810 and 820 may be positioned at the heights as illustrated in FIG. 4.

A first sub-edge 832 located between the first sub-reflective surface 812 and the second sub-reflective surface 814 and a second sub-edge 834 located between the third sub-reflective surface 822 and the fourth sub-reflective surface 824 may be positioned above the horizontal centerline 103. However, embodiments are not limited thereto. According to another embodiment, the first sub-edge 832 and the second sub-edge 834 may be positioned on or lower than the horizontal centerline 103.

Figure 12:
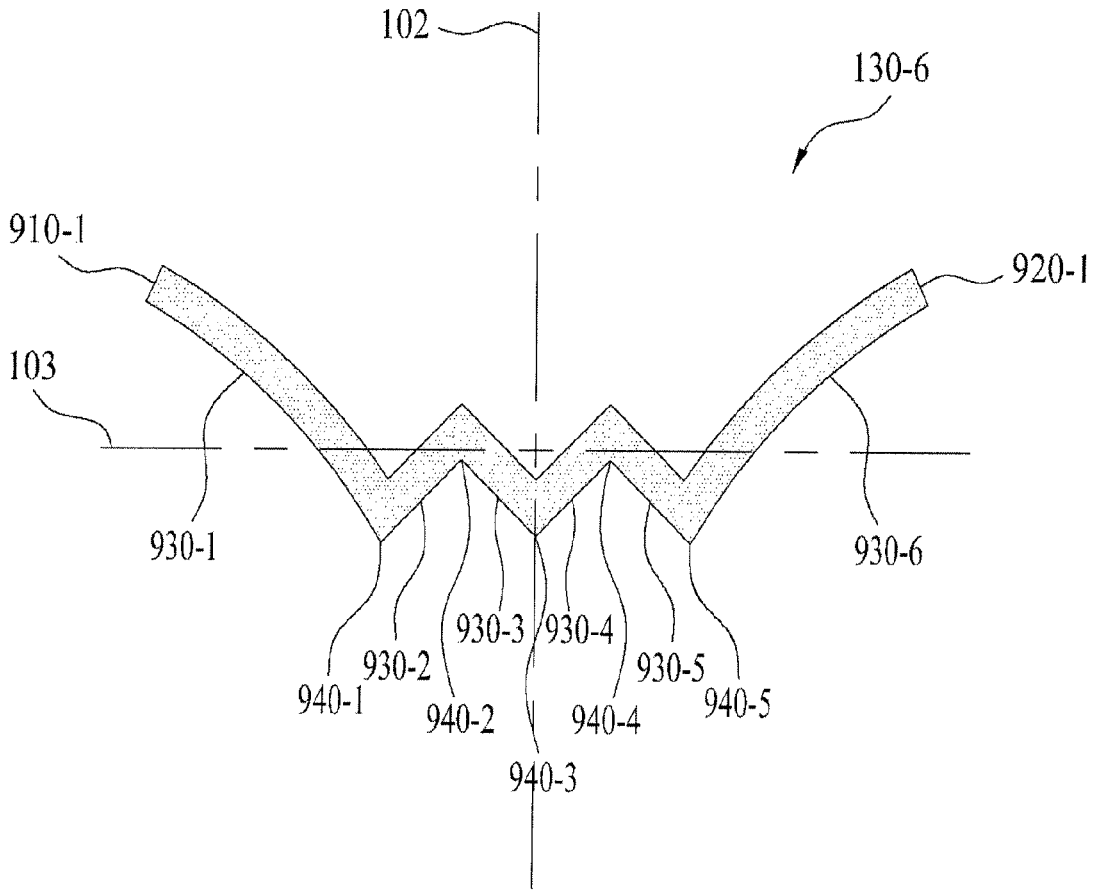
FIG. 12 is a cross-sectional view illustrating an illumination apparatus according to a ninth embodiment.
Figure 13:
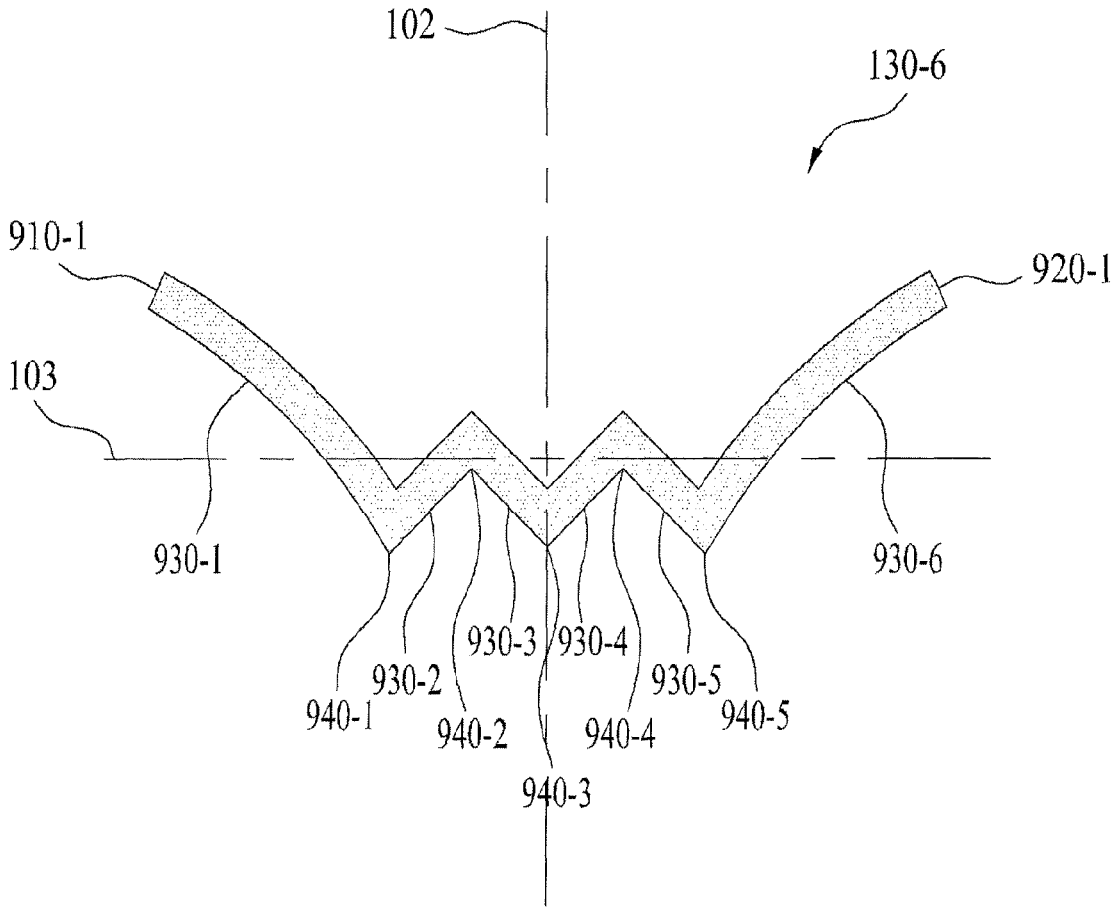
FIG. 13 is an enlarged view illustrating the reflective surfaces shown in FIG. 12.

FIG. 12 is a cross-sectional view illustrating an illumination apparatus 100-9 according to a ninth embodiment, and FIG. 13 is an enlarged view illustrating the reflective surfaces 930-1 to **930-*n* (n>1, where n is a natural number) shown in FIG. 12. Some reference numerals in FIG. 12 represent the same constituents as reference numerals in FIG. 3**, and thus description thereof will be briefly given or omitted.

Referring to FIGS. 12 and 13, the illumination apparatus 100-9 is a variation of the first embodiment. In the ninth embodiment, the reflector 130-6 may include a plurality of reflective surfaces 930-1 to **930-*n* (n>1, where n is a natural number) and edges 940-1 to 940-*m*** (m>1, where m is a natural number) positioned between two neighboring reflective surfaces.

The reflective surfaces 930-1 to **930-*n* (n>1, where n is a natural number) and edges 940-1 to 940-*m*** (m>1, where m is a natural number) may form a structure having concave and convex parts.

One end 910-1 of the first reflective surface 930-1 of the reflective surfaces 930-1 to **930-*n* (n>1, where n is a natural number) may adjoin one region of the inner circumferential surface 115 of the cover 110, and one end 910-2 of the last reflective surface 930-*n* may adjoin another region of the inner circumferential surface 115 of the cover 110**.

The edges 940-1 to **940-*m* (m>1, where m is a natural number) may be positioned at a height less than the heights of one end 910-1 of the first reflective surface 930-1 and one end 910-2 of the last reflective surface 930-*n* with respect to the upper surface of the substrate 124**.

The odd-numbered edges **940-(2*k*−1) (k≥1, where k is a natural number) may be positioned lower than the even-numbered edges 940-2*k*** (K≥1, where k is a natural number).

The ends 910-1 and 910-2 of the first reflective surface 930-1 and the last reflective surface **930-*n* adjoining the inner circumferential surface 115 of the cover 110 may be positioned above the horizontal centerline 103**.

For example, the height of the position of the ends 910-1 and 910-2 of the first reflective surface (e.g., 930-1) and the last reflective surface (e.g., 930-6) may be greater than the height of the horizontal centerline 103 and less than a reference value a (0<H<a). Herein, the reference value a may be identical to the one illustrated in FIG. 4.

The odd-numbered edges **940-(2*k*−1) (k≥1, where k is a natural number) may be positioned below the horizontal centerline 103. That is, the odd-numbered edges 940-(2*k*−1) (k≥1, where k is a natural number) may be positioned between the horizontal centerline 103 and the light emitting devices 122**.

The even-numbered edges **940-(2*k*) (k≥1, where k is a natural number) may be positioned below the horizontal centerline 103. However, embodiments are not limited thereto. According to another embodiment, the even-numbered edges 940-(2*k*) may be positioned above the horizontal centerline 103. For example, the even-numbered edges 940-(2*k*) (k≥1, where k is a natural number) may be positioned between the horizontal centerline 103 and the odd-numbered edges 940-(2*k*−1)** (k≥1, where k is a natural number).

One of odd-numbered edges **940-(2*k*−1) (k≥1, where k is a natural number), e.g., the edge 940-3 may be positioned on the vertical centerline 102, and the reflective surfaces 930-1 to 930-*n* (n>1, where n is a natural number) and edges 940-1 to 940-*m* (m>1, where m is a natural number) may be laterally symmetrical with respect to the vertical centerline 102**.

The odd-numbered edges **940-(2*k*−1) (k≥1, where k is a natural number) may be positioned at the same height to ensure equal and uniform distribution or reflection of light. However, embodiments are not limited thereto. In addition, the even-numbered edges 940-(2*k*)** (k≥1, where k is a natural number) may be positioned at the same height. However, embodiments are not limited thereto.

At least one of the reflective surfaces 930-1 to **930-*n*** (n>1, where n is a natural number) may be a flat surface, a concavely curved surface, or a convexly curved surfaces.

As described above, the illustrated embodiments (100-1 to 100-9) employ the insulating reflectors 130, 130-1 to 130-6. Thereby, electrical insulation between drive unit 140 and the light emitting module 120 may be improved and thus a separate insulation sheet may not need to be used to surround the drive unit 140.

In addition, in the illustrated embodiments (100-1 to 100-6), the reflectors 130 and 130-1 to 130-6 are disposed facing the light emitting module 120, and both ends of each of the reflectors 130 and 130-1 to 130-6 adjoining the inner circumferential surface 115 of the cover 110 are positioned above the horizontal centerline 103. Therefore, the beam angle may be enhanced and dazzling may be reduced.

As is apparent from the above description, embodiments may improve the beam angle and lower dazzling.

Embodiments provide an illumination apparatus which may improve the beam angle and lower dazzling.

In one embodiment, an illumination apparatus includes a tube type light-transmissive cover, light emitting module including a substrate disposed in one region of an inner circumferential surface of the cover and a plurality of light emitting devices disposed on the substrate, and a reflector extending in a longitudinal direction of the cover and comprising a first reflective surface, a second reflective surface, and an edge positioned between the first reflective surface and the second reflective surface, wherein one end of the first reflective surface and one end of the second reflective surface are connected to the inner circumferential surface of the cover.

The reflector may be a reflective sheet having a convex center in the direction of the light emitting module.

The one end of the first reflective surface may be positioned at one side of a vertical centerline, and the one end of the second reflective surface may be positioned at the other side of the vertical centerline, the vertical centerline being a straight line passing through a center of the cover and being perpendicular to an upper surface of the cover, wherein a height of a position of the edge from the upper surface of the substrate may be less than a height of a position of the one end of each of the first reflective surface and the second reflective surface from the upper surface of the substrate.

The edge may be aligned with the vertical centerline.

The edge may be positioned between a horizontal centerline and the light emitting devices, the horizontal centerline being a straight line passing the center of the cover and being parallel with the upper surface of the substrate.

Each of the first reflective surface and the second reflective surface may include at least one of a flat surface, a concavely curved surface, and a convexly curved surface.

The illumination apparatus may further include a drive unit positioned between the reflector and the inner circumferential surface of the cover and configured to drive the light emitting module, wherein the reflector may be positioned between the drive unit and the light emitting module.

A height of a position of the one end of each of the first reflective surface and the second reflective surface may be greater than a height of a position of the horizontal centerline.

The height of the one end of each of the first reflective surface and the second reflective surface may be less than a reference value, the reference value being a height of a point at which an extension of a straight line connecting an edge of an upper surface of each of the light emitting devices to an edge of a lower surface of the drive unit meets the inner circumferential surface of the cover.

The illumination apparatus may further include a protrusion provided in the one region of the inner circumferential surface of the cover to allow the substrate to be fitted into the cover in the longitudinal direction of the cover, wherein the protrusion and the one region of the inner circumferential surface of the cover may be formed of a reflective material.

The reflector may be formed of an insulating material.

The reflector may further include a reflective member positioned on the first reflective surface and the second reflective surface.

A region of the cover positioned at one side of the inner circumferential surface is open and the cover may be provided with opposite ends spaced apart from each other, the illumination apparatus further including a heat dissipation part inserted into a space between the opposite ends of the cover and fixed, wherein the substrate may be disposed on an upper surface of the heat dissipation part.

Each of the first reflective surface and the second reflective surface may include two or more sub-reflective surfaces having different slopes with respect to the vertical centerline.

The first reflective surface and the second reflective surface may be laterally symmetrical to each other with respect to the edge.

In another embodiment, an illumination apparatus includes a tube type light-transmissive cover, a light emitting module including a substrate disposed in one region of an inner circumferential surface of the cover and a plurality of light emitting devices disposed on the substrate, and a plurality of reflective surfaces and edges extending in a longitudinal direction of the cover, the plurality of reflective surfaces and edges forming a concave and convex structure, wherein one end of each of the first and last reflective surfaces of the reflective surfaces may be connected to an inner circumferential surface of the cover.

Heights of positions of the edges may be less than a height of a position of the one end of each of the first and last reflective surfaces.

One of the odd-numbered edges is aligned with a vertical centerline, and the plurality of reflective surfaces and edges may be laterally symmetrical with respect to the vertical centerline, wherein the vertical centerline may be a straight line passing through a center of the cover and perpendicular to an upper surface of the substrate.

The odd-numbered edges may be positioned between a horizontal centerline and the light emitting devices, wherein the horizontal centerline may be a straight line passing through the center of the cover and parallel with the upper surface of the substrate.

At least one of the reflective surfaces may be a flat surface, a concavely curved surface, or a convexly curved surface.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An illumination apparatus comprising:

a tube shaped cover;

a light emitting module having a substrate provided in one region of an inner circumferential surface of the cover and a plurality of light emitting devices provided on the substrate;

a reflector extending in a longitudinal direction of the cover and having a first reflective surface, a second reflective surface, and an edge positioned between the first reflective surface and the second reflective surface, the first and second reflective surfaces reflecting light emitted by the light emitting module; and a drive unit positioned between the reflector and the inner circumferential surface of the cover and configured to drive the light emitting module, wherein one end of the first reflective surface and one end of the second reflective surface are connected to an inner circumferential surface of the cover, wherein the edge is positioned between a horizontal centerline and the plurality of light emitting devices and spaced away from the inner circumferential surface of the cover, wherein the horizontal centerline is a straight line passing a center of the cover and is parallel with an upper surface of the substrate, wherein the edge vertically overlaps the plurality of light emitting devices along a vertical centerline, which passes through the center of the cover and is perpendicular to the upper surface of the substrate, wherein the horizontal centerline passes through the center of the cover that is equidistant along the vertical centerline from the inner circumferential surface of the cover, wherein the drive unit is provided on and contacts with a first surface of the reflector and a second surface of the reflector, the first surface being at an opposite side from the first reflective surface and the second surface being at an opposite side from the second reflective surface, wherein the first and second reflective surfaces are provided between the light emitting module and the drive unit, and wherein one end of the first surface and one end of the second surface are connected to the inner circumferential surface of the cover.

2. The illumination apparatus according to claim 1, wherein the reflector is a reflective sheet having a convex center in the direction of the light emitting module.

3. The illumination apparatus according to claim 2, wherein the one end of the first reflective surface is positioned at one side of the vertical centerline, and the one end of the second reflective surface is positioned at an other side of the vertical centerline, the vertical centerline being a straight line passing through a center of the cover and being perpendicular to an upper surface of the cover, wherein a height of a position of the edge from the upper surface of the substrate is less than a height of a position of the one end of each of the first reflective surface and the second reflective surface from the upper surface of the substrate.

4. The illumination apparatus according to claim 3, wherein the edge is aligned with the vertical centerline.

5. The illumination apparatus according to claim 4, wherein each of the first reflective surface and the second reflective surface comprises at least one of a flat surface, a concavely curved surface, and a convexly curved surface.

6. The illumination apparatus according to claim 4, wherein a height of a position of the one end of each of the first reflective surface and the second reflective surface with respect to a top surface of the substrate on which the light emitting devices are disposed is greater than a height of a position of the horizontal centerline.

7. The illumination apparatus according to claim 6, wherein the height of the one end of each of the first reflective surface and the second reflective surface is less than a reference value, the reference value being a height of a point at which an extension of a straight line connecting an edge of an upper surface of each of the light emitting devices to an edge of a lower surface of the drive unit meets the inner circumferential surface of the cover.

8. The illumination apparatus according to claim 4, further comprising a protrusion provided in the one region of the inner circumferential surface of the cover to allow the substrate to be fitted into the cover in the longitudinal direction of the cover, wherein the protrusion and the one region of the inner circumferential surface of the cover are formed of a reflective material.

9. The illumination apparatus according to claim 7, wherein the reflector is formed of an electrically insulating material.

10. The illumination apparatus according to claim 7, wherein the reflector further comprises a reflective member positioned on the first reflective surface and the second reflective surface.

11. The illumination apparatus according to claim 7, wherein a region of the cover positioned at one side of the inner circumferential surface is open and the cover is provided with opposite ends spaced apart from each other, the illumination apparatus further comprising a heat dissipation part inserted into a space between the opposite ends of the cover and fixed, wherein the substrate is disposed on an upper surface of the heat dissipation part.

12. The illumination apparatus according to claim 3, wherein each of the first reflective surface and the second reflective surface comprises two or more sub-reflective surfaces having different slopes with respect to the vertical centerline.

13. The illumination apparatus according to claim 7, wherein the first reflective surface and the second reflective surface are laterally symmetrical to each other with respect to the edge.

14. An illumination apparatus comprising:

a tube shaped cover;

a light emitting module having a substrate provided in one region of an inner circumferential surface of the cover and a plurality of light emitting devices provided on the substrate;

a reflector including a plurality of reflective surfaces and edges extending in a longitudinal direction of the cover, the plurality of reflective surfaces and edges forming a concave and convex structure, the plurality of reflective surfaces reflecting light emitted by the light emitting module; and a drive unit positioned between the reflector and the inner circumferential surface of the cover and configured to drive the light emitting module, wherein the plurality of edges are spaced away from an inner circumferential surface of the cover, wherein one end of each of a first reflective surface and a last reflective surface of the reflective surfaces is connected to the inner circumferential surface of the cover, wherein odd numbered edges are positioned between a horizontal centerline and the plurality of light emitting devices and the horizontal centerline is a straight line passing a center of the cover and is parallel with an upper surface of the substrate, wherein at least one edge of the plurality of edges of the reflector vertically overlaps the plurality of light emitting devices along a vertical centerline, which passes through the center of the cover and is perpendicular to the upper surface of the substrate, wherein the horizontal centerline passes through the center of the cover that is equidistant along the vertical centerline from the inner circumferential surface of the cover, wherein the drive unit is provided on and contacts with a plurality of opposite surfaces of the reflector, the plurality of opposite surfaces being at an opposite side of the reflector from the plurality of reflective surfaces, wherein the first and second reflective surfaces are provided between the light emitting module and the drive unit, and wherein one end of each of a first opposite surface and a last opposite surface of the plurality of opposite surfaces is connected to the inner circumferential surface of the cover.

15. The illumination apparatus according to claim 14, wherein heights of positions of the edges are less than a height of a position of the one end of each of the first and last reflective surfaces.

16. The illumination apparatus according to claim 15, wherein one of the odd-numbered edges is aligned with the vertical centerline, and the plurality of reflective surfaces and edges are laterally symmetrical with respect to the vertical centerline.

17. The illumination apparatus according to claim 16, wherein at least one of the plurality of reflective surfaces is a flat surface, a concavely curved surface, or a convexly curved surface.

18. The illumination apparatus according to claim 1, wherein the plurality of light emitting devices are aligned with the vertical centerline and are perpendicular to the upper surface of the substrate.

19. The illumination apparatus according to claim 17, wherein the plurality of light emitting devices are aligned with the vertical centerline and are perpendicular to the upper surface of the substrate.

20. The illumination apparatus according to claim 17, wherein heights of the odd numbered edges, with respect to the upper surface of the substrate, are the same as each other.

* * * * *